US011673707B2

(12) United States Patent
Altman

(10) Patent No.: US 11,673,707 B2
(45) Date of Patent: Jun. 13, 2023

(54) CHILD-RESISTANT CONTAINER ASSEMBLY

(71) Applicant: RIPA, LLC, Broadview, IL (US)

(72) Inventor: Jason Altman, Los Angeles, CA (US)

(73) Assignee: RIPA, LLC, Broadview, IL (US)

( * ) Notice: Subject to any disclaimer, the term of this patent is extended or adjusted under 35 U.S.C. 154(b) by 310 days.

(21) Appl. No.: 16/850,145

(22) Filed: Apr. 16, 2020

(65) Prior Publication Data

US 2021/0323719 A1 Oct. 21, 2021

(51) Int. Cl.

| | |
|---|---|
| ***B65D 50/06*** | (2006.01) |
| ***B65D 5/38*** | (2006.01) |
| ***B65D 50/04*** | (2006.01) |

(52) U.S. Cl.

CPC ..... *B65D 5/38* (2013.01); *B65D 50/046* (2013.01)

(58) Field of Classification Search

CPC ..... B65D 5/38; B65D 5/503; B65D 5/5038; B65D 50/046; B65D 2215/02; B65B 69/0008; B65B 69/00

USPC ..... 206/1.5, 468; 53/492; 229/125.125

See application file for complete search history.

(56) References Cited

U.S. PATENT DOCUMENTS

| | | | | |
|---|---|---|---|---|
| 2,426,911 | A * | 9/1947 | Williamson | B65D 5/38 206/532 |
| 4,534,463 | A * | 8/1985 | Bouchard | B65D 85/1009 229/122 |
| 7,377,385 | B2 * | 5/2008 | Giannini | B65D 5/38 229/125.125 |
| 7,866,466 | B2 * | 1/2011 | Rose | B65D 85/1036 206/270 |
| 10,730,671 | B2 * | 8/2020 | Drosos | B65D 50/066 |
| 2016/0251107 | A1 * | 9/2016 | Everett | B65D 59/04 206/1.5 |
| 2020/0180808 | A1 * | 6/2020 | Gauvin | B65D 5/38 |
| 2021/0016939 | A1 * | 1/2021 | Palmer | B65D 5/44 |
| 2021/0107712 | A1 * | 4/2021 | Chambers | B65D 50/066 |

* cited by examiner

*Primary Examiner* — Luan K Bui
(74) *Attorney, Agent, or Firm* — Nixon Peabody LLP

(57) ABSTRACT

A container assembly includes an outer cover and a container. The front of the outer cover includes a minor front flap located on an interior surface thereof. The front of the container includes at least one minor exterior flap. The container is received in the open end of the outer cover, The container forms an aperture. The minor front flap of the outer cover and the minor exterior flap of the container are generally aligned in a plane in a closed position of the container assembly to prevent or inhibit opening thereof. The outer cover initially moves with respect to the container by pushing the front of the container and moving the outer cover such that the minor front flap of the outer cover clears the minor exterior flap of the container allowing the container assembly to be moved from the closed position to an open position.

22 Claims, 6 Drawing Sheets

CHILD-RESISTANT CONTAINER ASSEMBLY

FIELD OF THE INVENTION

The present invention relates generally to container assemblies. In particular, the present invention relates to container assemblies that are child-resistant.

BACKGROUND

Flat sheets of paperboard, typically referred to as blanks, have been used for many years as the starting material to form containers. Paperboard containers may be made of single or multiple layers. Container assemblies or packages are adapted to contain and secure a product. Some of these products are not meant or desired for children. Thus, with these types of products, it is often desirable to have child-resistance features associated with the package to prevent or inhibit children from gaining access to the product located within the package.

In addition to having a child-resistant container assembly or package, it is desirable to have other attributes such as a container assembly that is easy to pack with product, sturdy and fully enclosed for protecting contents during storage and shipping, and aesthetically pleasing to customers.

Therefore, it would be desirable to have a child-resistant container assembly that addresses many, if not all, of these attributes.

SUMMARY

According to one embodiment, a container assembly includes an outer cover and a container. The outer cover includes a front, a back, first and second sides, a top and an open end opposite of the top. The front of the outer cover includes a minor front flap located on an interior surface of the outer cover. The container includes a front, a back, first and second sides, and a bottom. The front of the container includes at least one minor exterior flap. The container is configured to be received in the open end of the outer cover when in a closed position. The container forms an aperture. The minor front flap of the outer cover and the at least one minor exterior flap of the container are generally aligned in a plane in a closed position of the container assembly to prevent or inhibit opening of the container assembly. The outer cover is configured to initially move with respect to the container by pushing the front of the container and moving the outer cover with respect to the container such that the minor front flap of the outer cover clears the at least one minor exterior flap of the container allowing the container assembly to be moved from the closed position to an open position.

According to another embodiment, a container assembly includes an outer cover blank and a container blank. The outer cover blank includes a first plurality of panels and a first plurality of flaps integrally formed from a first sheet of material configured to form an outer cover. The first plurality of panels includes a first side panel, a second side panel, a back panel, a front panel and a top panel. The first plurality of flaps includes a minor front flap being attached to the front panel via a fold line. The container blank includes a second plurality of panels and a second plurality of flaps integrally formed from a second sheet of material configured to form a container. The second plurality of panels includes a first side panel, a second side panel, a back panel, a front panel and a bottom panel of the container. The back panel assists in forming an aperture. The second plurality of flaps includes at least one minor front flap configured to be folded and attached to the front panel. The container is configured to be received in the outer cover in a closed position. The outer cover is configured to initially move with respect to the container by pushing the front panel of the container and moving the outer cover with respect to the container such that the minor front flap of the outer cover clears the at least one minor flap attached to the front panel of the container allowing the container assembly to be moved from the closed position to an open position.

According to one method, a container assembly is provided in a closed position. The container assembly includes an outer cover and a container. The outer cover includes a front, a back, first and second sides, a top and an open end opposite of the top. The front of the outer cover includes a minor front flap located on an interior surface of the outer cover. The container includes a front, a back, first and second sides, and a bottom. The front of the container includes at least one minor exterior flap. The container is configured to be received in the open end of the outer cover when in a closed position. The container forms an aperture. The minor front flap of the outer cover and the at least one minor exterior flap of the container are generally aligned in a plane in a closed position of the container assembly to prevent or inhibit opening of the container assembly. The front of the container below an edge of the outer cover is pushed such that the minor front flap of the outer cover clears the at least one minor exterior flap of the container and the outer cover is simultaneously moved away from the container such the container assembly moves from the closed position to an open position.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
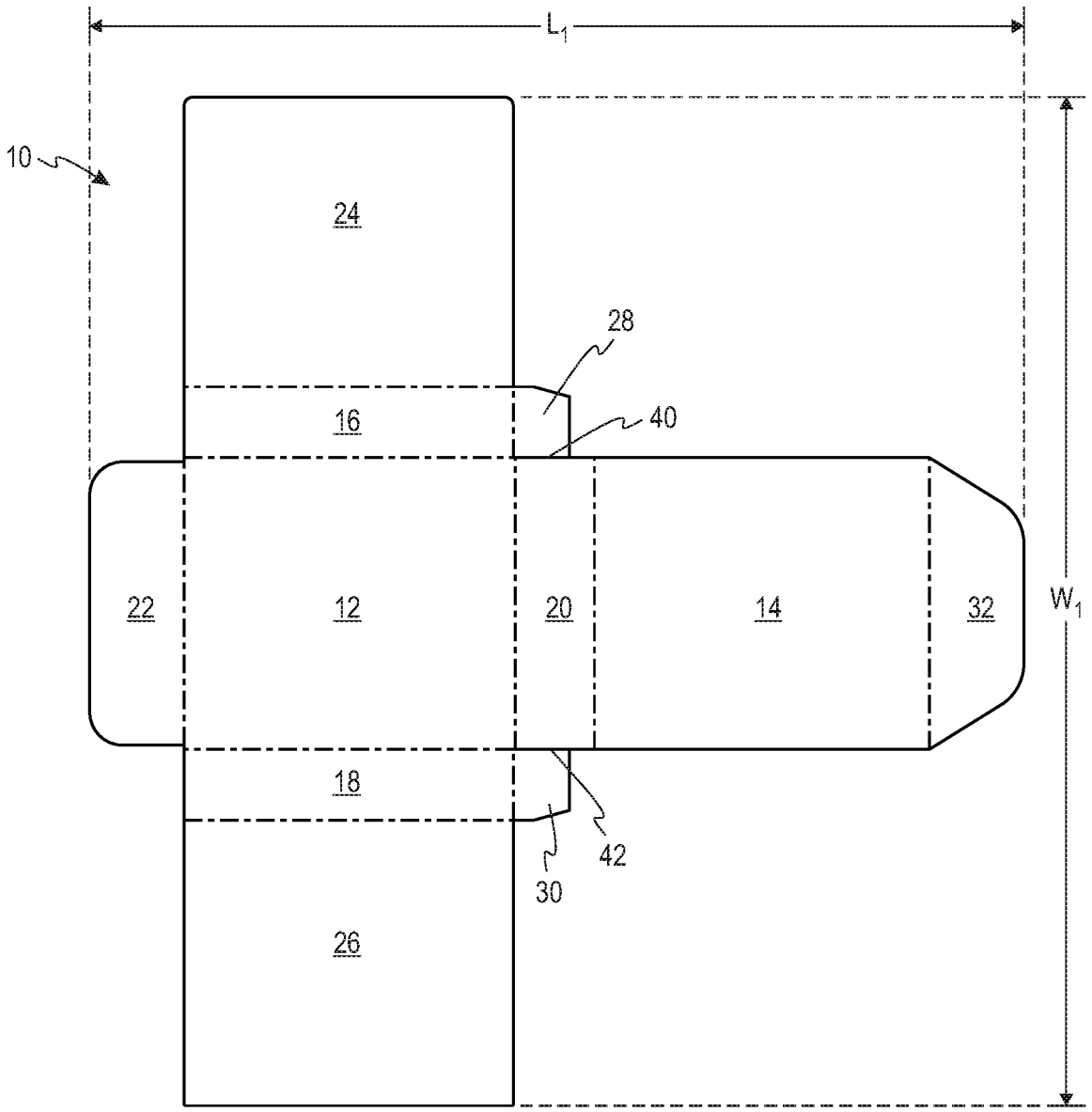
FIG. 1 is a top plan view of a first blank for forming an outer cover to be used in a container assembly according to one embodiment of the present disclosure.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIG. 1 illustrates a top plan view of a blank 10 for forming an outer cover (also referred to as an "outer cover blank") to be used in a child-resistant container assembly according to one embodiment of the present disclosure. The outer cover blank 10 includes a plurality of panels and a plurality of flaps. Specifically, the outer cover blank 10 includes a back panel 12, a front panel 14, a first side panel 16, a second side panel 18, and a top panel 20.

The outer cover blank 10 further includes a minor back flap 22, a minor front flap 32, a first major front flap 24, a second major front flap 26, a first minor top flap 28, and a second minor top flap 30. Adjacent panels or flaps 22, 12, 20, 14 and 32 are connected with one another by substantially parallel fold lines as shown in FIG. 1. Similarly, adjacent panels or flaps 24, 16, 12, 18, and 26 are connected with one another by substantially parallel fold lines as shown in FIG. 1.

The first major front flap 24 and the second major front flap 26 are hingedly connected to the first side panel 16 and the second side panel 18, respectively, via fold lines. The back panel 12 is hingedly connected to the top panel 20 and the minor back flap 22 via fold lines as shown in FIG. 1. Similarly, the front panel 14 is hingedly connected to the minor front flap 32 and the top panel 20 via fold lines. The first minor top flap 28 and the second minor top flap 30 are hingedly connected to the first side panel 16 and the second side panel 18, respectively, via fold lines. The top panel 20 is separated from the first minor top flap 28 and the second minor top flap 30 by cut lines 40, 42, respectively.

The general dimensions of the outer cover blank 10 are shown in FIG. 1. Specifically, a length L1 of the outer cover blank 10 is generally from about 5 to about 20 inches and, more specifically, from about 5 to about 15 inches. The length L1 of the outer cover blank 10 is typically from about 5 to about 10 inches. Width W1 of the outer cover blank 10 is generally from about 5 to about 25 inches and, more specifically, from about 5 to about 15 inches. The width W1 of the outer cover blank 10 is typically from about 5 to about 10 inches.

The outer cover blank 10 can be assembled according to one embodiment of the present disclosure to be used in a child-resistant container assembly. The first major front flap 24 is folded inwardly so as to be aligned generally perpendicularly to the first side panel 16. The second major front flap 26 is folded inwardly so as to be aligned generally perpendicularly to the second side panel 18. The first major front flap 24 and the second major front flap 26 are generally overlapped and adhered to each other. The front panel 14 is then folded inwardly, adhered to the second major front flap 26 and aligned parallel to the back panel 12. The minor back flap 22 is folded over and adhered to the back panel 12, and the minor front flap 32 is folded over and adhered to the first major front flap 24.

The front panel 14, the first major front flap 24 and the second major front flap 26 form the front of the assembled cover, which will be discussed below. It is contemplated that the front of the outer cover may be formed in a different manner than described above. For example, the second major front flap 26 may be folded inwardly first, then the first major front flap 24 may then be folded inwardly and adhered to the front flap 26. Thus, the front panel 14 may then be folded inwardly and adhered to the first major front flap 24, and the minor front flap 32 is folded over and adhered to the second major front flap 26.

It is contemplated that the outer cover may be formed by other blanks than that depicted exactly in FIG. 1. For example, in another embodiment of an outer cover assembly, a minor back flap adjacent to the back panel may be omitted from the blank.

Figure 2:
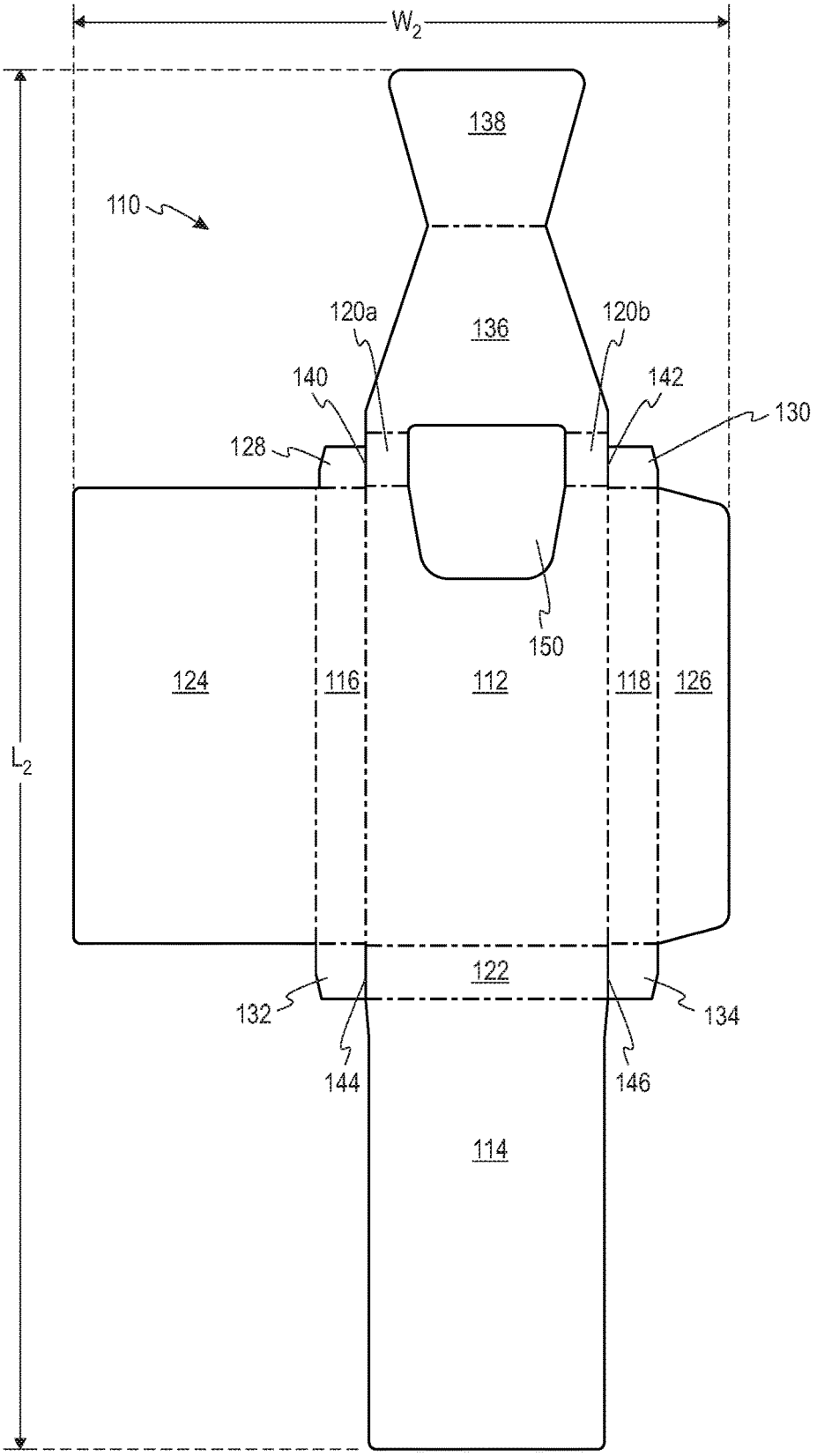
FIG. 2 is a top plan view of a second blank for forming a container to be used in a container assembly according to one embodiment of the present disclosure.

Turning now to FIG. 2, a top plan view of a blank 110 for forming a container (also referred to as an "container blank") to be used in a child-resistant container assembly according to one embodiment is shown. The container blank 110 includes a plurality of panels and a plurality of flaps. Specifically, the container blank 110 includes a back panel 112, a front panel 114, a first side panel 116, a second side panel 118, first and second top panels 120*a*, 120*b*, and a bottom panel 122.

The container blank 110 further includes a major front flap 124, a minor front flap 126, a first minor top flap 128, a second minor top flap 130, a first minor bottom flap 132, and a second minor bottom flap 134. The container blank 110 further includes a first minor front flap 136 and a second minor front flap 138. Adjacent panels or flaps 114, 122, 112, 120*a*, 120*b*, 136, and 138 are connected with one another by substantially parallel fold lines as shown in FIG. 2. Similarly, adjacent panels or flaps 124, 116, 112, 118, and 126 are connected with one another by substantially parallel fold lines as shown in FIG. 2.

The major front flap 124 and the minor front flap 126 are hingedly connected to the first side panel 116 and the second side panel 118, respectively, via fold lines. The back panel 112 and the front panel 114 are hingedly connected to the bottom panel 122, via respective fold lines. The back panel 112 is hingedly connected to the first and second top panels 120*a*, 120*b* via fold lines. The first minor front flap 136 is hingedly connected to the top panels 120*a*, 120*b* via fold lines. The second minor front flap 138 is hingedly connected to the first minor front flap 136 via a fold line.

The first minor top flap 128 and the second minor top flap 130 are hingedly connected to the first side panel 116 and the second side panel 118, respectively, via fold lines. The first minor top flap 128 and the second minor top flap 130 are separated from the first and second top panels 120*a*, 120*b*, respectively, by cut lines 140, 142. Similarly, the first minor bottom flap 132 and the second minor bottom flap 134 are hingedly connected to the first side panel 116 and the second side panel 118, respectively, via fold lines. The first minor bottom flap 132 and the second minor bottom flap 134 are separated from the bottom panel 122 via cut lines 144, 146, respectively.

The back panel 112, the top panels 120*a*, 120*b* and the first minor front flap 136 together form an aperture 150. The aperture 150 is shown as being a generally rectangular shape in FIG. 2. It is contemplated that the aperture may be of other shapes and sizes than that depicted in FIG. 2.

The general dimensions of the container blank 110 are shown in FIG. 2. Specifically, a length L2 of the container blank 110 is generally from about 5 to about 40 inches and, more specifically, from about 10 to about 30 inches. The length L2 of the container blank 110 is typically from about 5 to about 20 inches. Width W2 of the container blank 110 is generally from about 3 to about 20 inches and, more specifically, from about 5 to about 15 inches. The width W2 of the container blank 110 is typically from about 5 to about 10 inches.

In one method of forming a container from the container blank 110, the minor front flap 126 is folded inwardly so as to be aligned generally perpendicularly to the second side panel 118. The major front flap 124 is folded inwardly and then adhered to the minor front flap 126. The major front flap 124 with the minor front flap 126 is aligned generally perpendicularly to the first side panel 116. The first minor bottom flap 132 and the second minor bottom flap 134 are folded inwardly. The front panel 114 is then folded inwardly, adhered to the major front flap 124, and aligned generally parallel to the back panel 112. The first minor top flap 128 and second minor top flap 130 are folded inwardly. The second minor front flap 138 is folded inwardly and adhered to the first minor front flap 136. The first minor front flap 136 with the adhered second minor front flap 138 is folded inwardly and adhered to the front panel 114. The front panel 114, the major front flap 124 and the minor front flap 126 form the front of the assembled cover, which will be discussed below.

It is contemplated that the front of a container may be formed in a different manner than described above. For example, in another process, the major front flap 124 may be folded inwardly first, then the minor front flap 126 is folded inwardly and adhered to the major front flap 124. Then, the front panel 114 is folded inwardly and adhered to at least one and desirably both the major front flap 124 and the minor front flap 126.

Figure 3A:
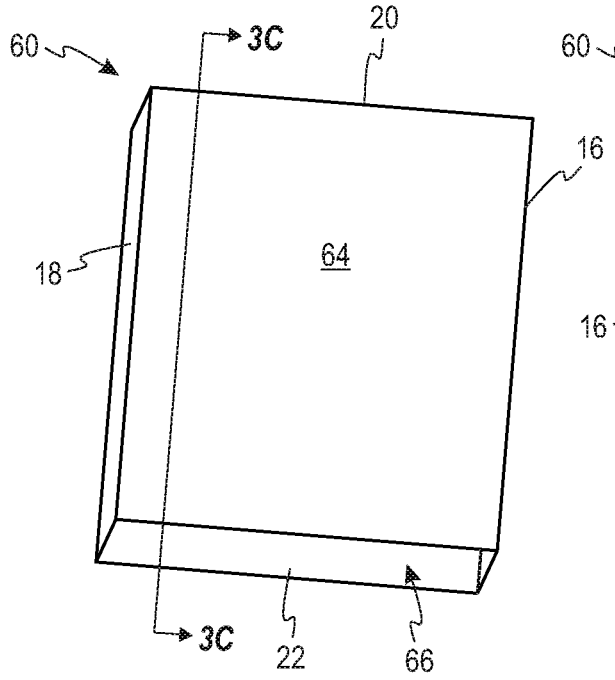
FIG. 3A is a front perspective view of an assembled outer cover formed from the first blank of FIG. 1.
Figure 3B:
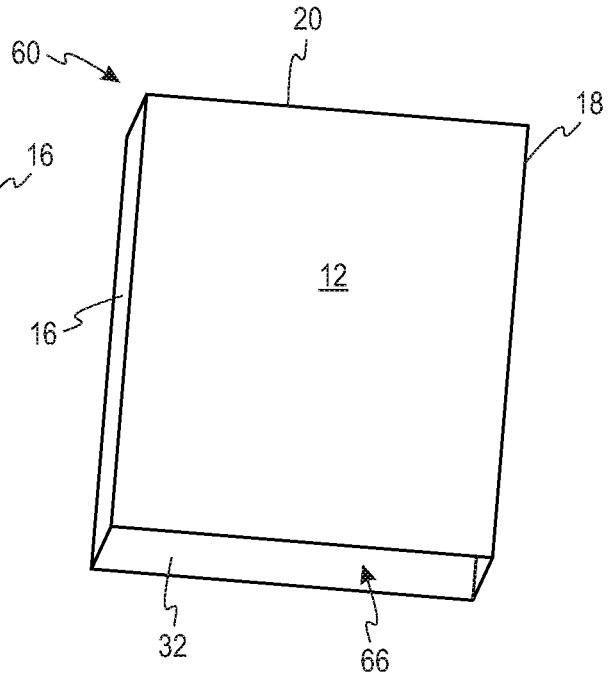
FIG. 3B is a back perspective view of the assembled outer cover of FIG. 3A.
Figure 3C:
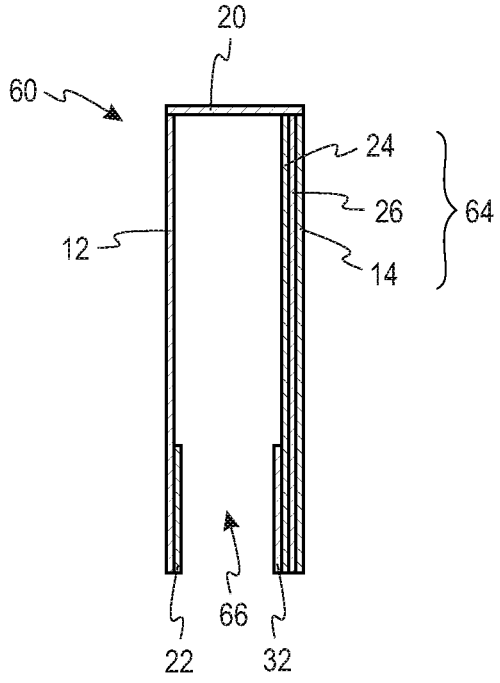
FIG. 3C is a cross-sectional view of the assembled outer cover taken generally along the line 3C-3C in FIG. 3A.

According to one method, the outer cover blank 10 of FIG. 1, is formed into an assembled outer cover 60 depicted in FIGS. 3A-3C. The outer cover 60 includes a front 64, a back (formed by the back panel 12), the minor back flap 22, the minor front flap 32, a first side (formed from the first side panel 16), a second side (formed from the second side panel 18), and a top (formed from the top panel 20). The outer cover 60 includes an open end 66 for receiving a container 160 (shown in FIGS. 4A-C). The open end 66 is located opposite of the top panel 20. The front 64 is formed from the front panel 14, the first major front flap 24, and the second major front flap 26, as shown in FIG. 3C. FIG. 3C also depicts the minor back flap 22 and the minor front flap 32 adhered to the back panel 12 and the first major front flap 24, respectively. The minor front flap 32 as shown in FIG. 3C is on an interior surface of the outer cover 60.

As discussed above, the first and second major front flaps 24, 26 may be reversed in order as shown in FIG. 3C. In such an embodiment, the first major front flap 24 is located between the second major front flap 26 and the front panel 14. In this embodiment, the minor front flap 32 is located adjacent to the second major front flap 26.

Figure 4A:
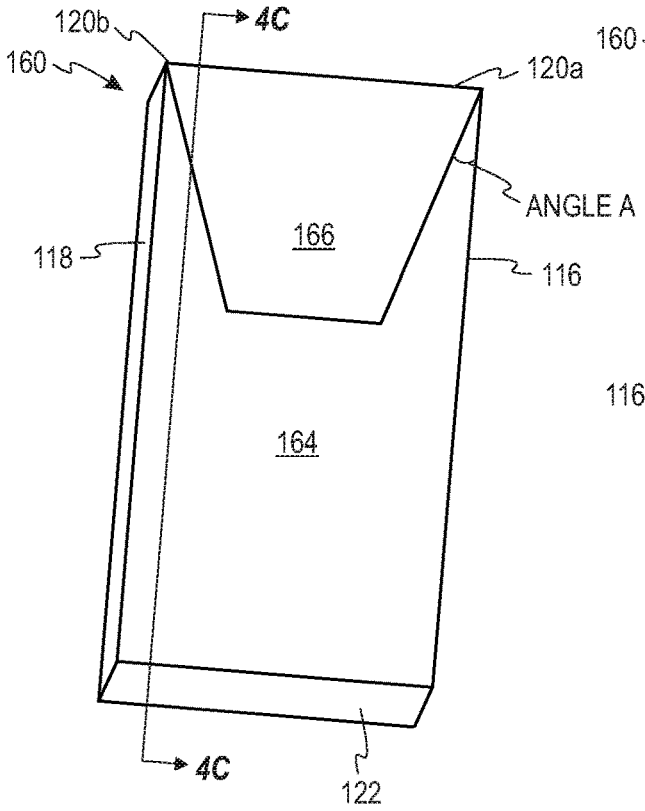
FIG. 4A is a front perspective view of an assembled container formed from the second blank of FIG. 2.
Figure 4B:
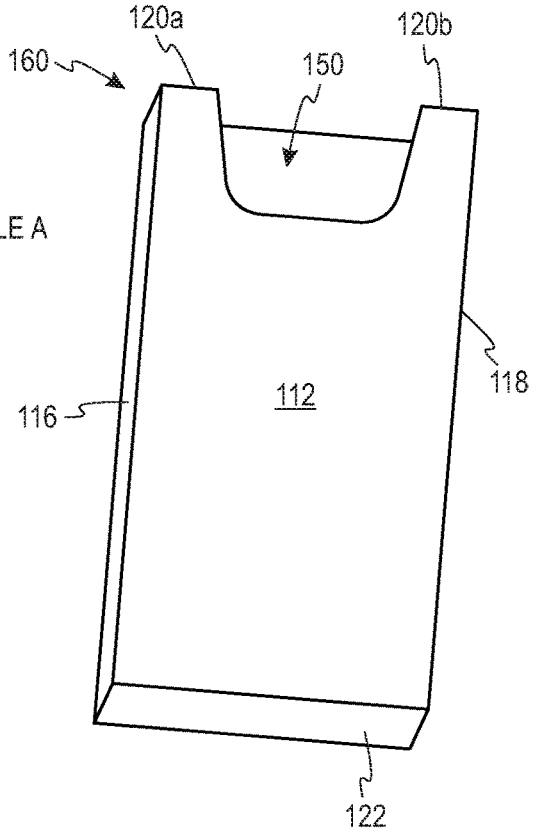
FIG. 4B is a back perspective view of the assembled container of FIG. 4A.
Figure 4C:
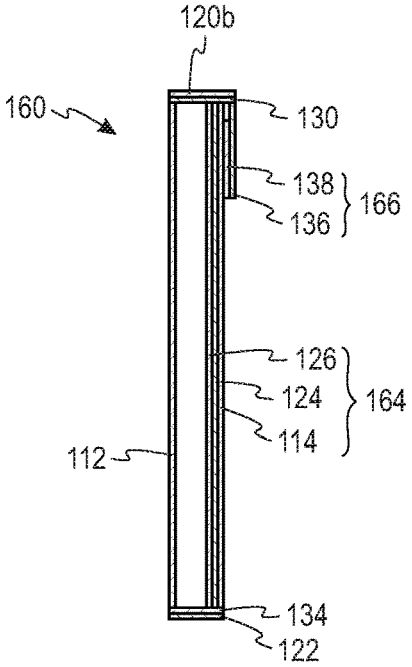
FIG. 4C is a cross-sectional view of the container assembly taken generally along the line 4C-4C in FIG. 4A.

According to one method, the container blank 110 of FIG. 2 may be formed into a container 160 as shown in FIGS. 4A-4C. The container 160 includes a front 164, a back (formed by the back panel 112), a minor exterior flap 166, a first side (formed from the first side panel 116), a second side (formed from the second side panel 118), a bottom (formed from the bottom side panel 122 and the first and second minor bottom flaps 132, 134), and top portions (formed from the top panels 120*a*, 120*b*, and the first and second minor top flaps 128, 130). The container 160 includes an aperture 150 for receiving contents. The front 164 of FIGS. 4A-4C is formed from the front panel 114, the major front flap 124, and the minor front flap 126. The exterior flap 166 of FIG. 4A is formed from the first minor front flap 136 and the second minor front flap 138.

As shown in FIG. 4A, the minor exterior flap 166 generally tapers inwardly towards a center of the container 160 at an angle A. The angle A is generally from about 10 to about 60 degrees and, more specifically, from about 20 to about 50 degrees. The minor exterior flap 166 is shown as tapering at a consistent angle inwardly. By having the minor exterior flap 166 tapering inwardly, this assists a user in clearing the minor front flap 32 from the minor exterior flap 166 as will be discussed below because there is less material providing resistance to this movement.

It is contemplated that the shape of the minor exterior flap 166 may be different than that depicted in FIG. 4A. For example, the minor exterior flap may initially extend downwardly along the periphery of the container before tapering inwardly towards the center of the container. It is contemplated that the minor exterior flap may taper inwardly at multiple angles or have discontinuities in the inwardly tapering.

In the depressed position, the minor front flap 32 will clear the minor exterior flap 166 so there is nothing preventing or inhibiting the outer cover 60 from being removed with respect to the container 160.

Referring specifically to FIGS. 4A and 4C, a cross-sectional view is taken generally along line 4C-4C of FIG. 4A. This view is taken through the top panel 120*b*, the second minor top flap 130, the second minor bottom flap 134 and the bottom panel 122.

Figure 5A:
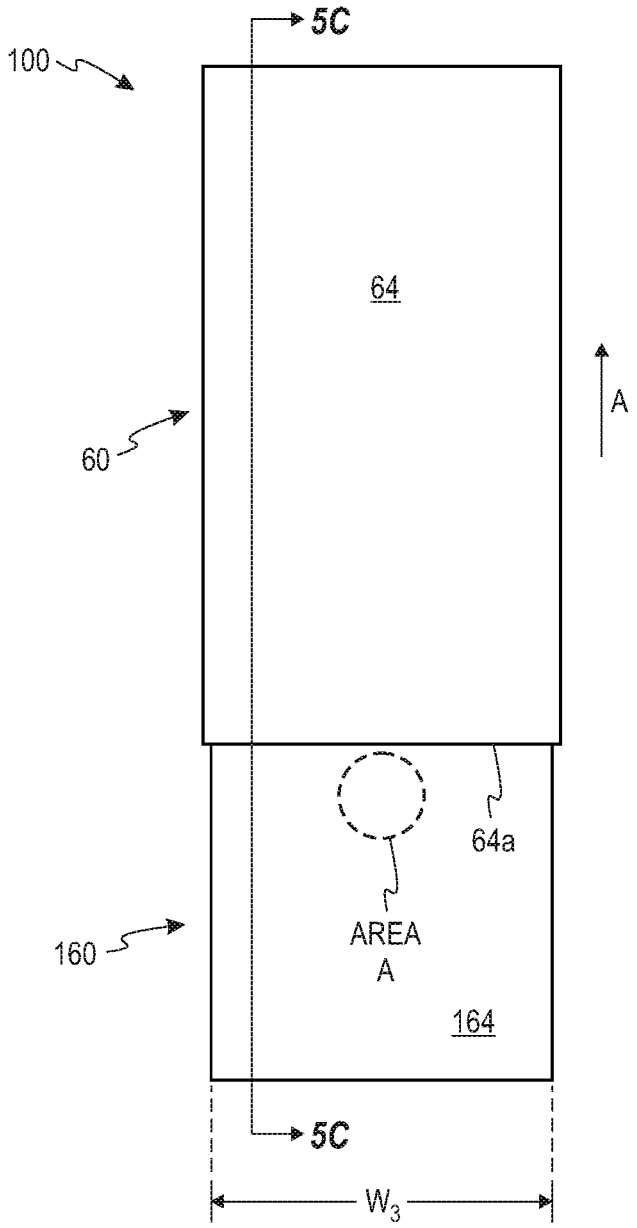
FIG. 5A is a front perspective view of a container assembly according to one embodiment formed from the assembled outer cover of FIGS. 3A-C and assembled container of FIGS. 4A-4C.
Figure 5B:
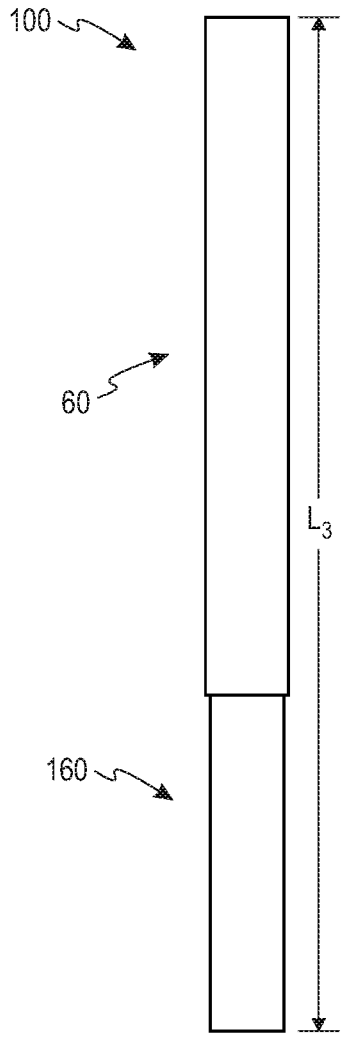
FIG. 5B is a side view of the container assembly of FIG. 5A.

The general dimensions of the container assembly are shown in FIGS. 5A, 5B. Specifically, a length L3 of the container assembly 100 is generally from about 5 to about 40 inches and, more specifically, from about 10 to about 30 inches. The length L3 of the container assembly 100 is typically from about 5 to about 20 inches. Width W3 of the container assembly 100 is generally from about 3 to about 20 inches and, more specifically, from about 5 to about 15 inches. The width W3 of the container assembly 100 is typically from about 5 to about 10 inches.

Figure 5C:
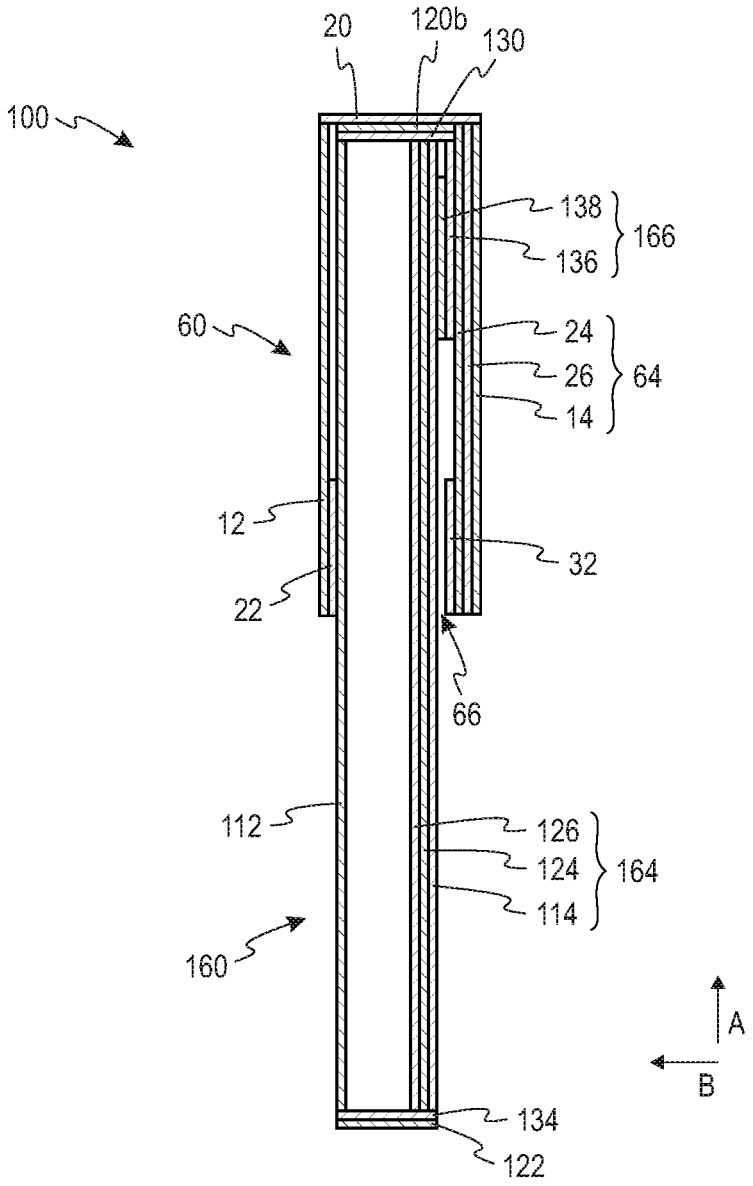
FIG. 5C is a cross-sectional view of the container assembly taken generally along the line 5C-5C in FIG. 5A.

To form a child-resistant container assembly, the outer cover 60 is initially placed over and received by the container 160 to form a container assembly 100 as shown in FIGS. 5A-C. Specifically, as shown in FIGS. 5A-C, the outer cover 60 encloses a portion of the container assembly 100 in a closed position. When in the closed position, the aperture 150 (shown in FIG. 4B) is not exposed.

To open the child-resistant container assembly 100, the outer cover 60 needs to be separated from the container 160 to be in an open position. To move the container assembly 100 from a closed position to an open position, the minor exterior flap 166 must clear the minor front flap 32. Referring to FIG. 5C, if a user moves the outer cover 60 from the container 160 in a generally direction of arrow A, the outer cover 60 will not separate from the container 160 because the minor front flap 32 will be impeded or restricted by the minor exterior flap 166, which prevents or inhibits the container assembly 100 from opening. As shown in FIG. 5C, the positioning of the minor front flap 32 is in the vertical plane of the minor exterior flap 166 or, more specifically, the first minor front flap 136 of the container 160 and the minor front flap 32 of the outer cover 60 are in the exact vertical plane as shown in FIG. 5C.

Referring specifically to FIGS. 5A, 5C, to enable clearance of the minor front flap 32 and the minor exterior flap 166, a user first contacts and presses downwardly at or around depressible area A of the container 160 as shown in of FIG. 5A. The contact and pressure at depressible area A of the container 160 is in the general direction of arrow B in FIG. 5C. The depressible area A may include any area located on the front 164 (see FIG. 4A) of the container 160 that when pushed or depressed would cause the minor exterior flap 166 of the container 160 to move slightly inwardly (direction of arrow B in FIG. 5C) such that it is no longer generally in the same plane as the minor front flap 32. The depressible area A of FIG. 5A is located generally adjacent to an edge 64*a* of the front 64 of the outer cover 60.

Once the container assembly 100 is in the depressed position (movement in the direction of arrow B in FIG. 5C), a user can then grasp and move the outer cover 60 in the direction of arrow A. In the depressed position, the minor front flap 32 will clear the minor exterior flap 166 so there is nothing preventing or inhibiting the outer cover 60 from being removed with respect to the container 160. This operation may be performed with one hand or, alternatively, may be performed with two hands.

As shown best in FIG. 4B, once the container assembly 100 is in the open position, products or contents within the container 160 can be accessed through the aperture 150. It is contemplated that product may be removed even before the container assembly 100 is a fully open position.

It is contemplated that other embodiments using the principles of the present invention may be formed. For example, instead of two blanks forming the container assembly, additional blanks may be used. For example, the at least one minor exterior flap of the container blank may be formed from a separate and distinct blank from the container blank. This separate blank including the at least one minor exterior flap may be attached to the container blank. In such an embodiment, the container may not include a top section.

Alternatively, the at least one minor exterior flap of the container may be formed from the container blank in which the at least one minor exterior flap is formed adjacent to, for example, a side panel or the front panel and is folded over in a similar position as described above in the process of forming the container 160.

It is contemplated that many different of products may be included in the child-resistant container assembly including, but not limited to, marijuana, e-cigarettes, cigarettes, lipstick, makeup, candy and pens. Typically, the products to be included are those that are desirable to keep away from children. It is contemplated, however, that other products that are safe with children may be included in the container assembly.

It is contemplated that the container assembly may include advertising features, descriptions, graphics, or other information thereon. Some additional information may include written or visual instructions on how to access the contents of the child-resistant container assembly 100.

The container assemblies of the embodiments described herein are typically manufactured using paperboard. The paperboard to form to each of the blanks is desirably formed from a single sheet. It is contemplated that the paperboard may be formed from multiple sheets.

It is to be understood that the principles of this invention could be applied to containers made of other materials, such as corrugated paperboards, cardboard, corrugated fiberboard, non-corrugated fiberboard, solid-fiber board, polymeric materials, foldable metals and other foldable materials. Corrugated paperboard generally refers to a multi-layer sheet material comprised of two sheets of liner bonded to a central corrugated layer of medium. It is contemplated that the materials for forming the different blanks may be made of different materials.

While the container assemblies of the embodiments described above include adhesive or glue for attaching various panels and flaps of the container assemblies, it is contemplated that any other suitable method of joining or attaching panels and flaps may be utilized such as, for example, staples, tapes, a system of corresponding slits and tabs, combinations thereof, and/or the like.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container assembly comprising:

an outer cover including a front, a back, first and second sides, a top and an open end opposite of the top, the front of the outer cover including a minor front flap located on an interior surface of the outer cover; and a container including a front, a back, first and second sides, and a bottom, the front of the container including at least one minor exterior flap, the at least one minor exterior flap of the container including two minor front flaps, the container being configured to be received in the open end of the outer cover when in a closed position, the container forming an aperture;

wherein the minor front flap of the outer cover and the at least one minor exterior flap of the container are generally aligned in a plane in a closed position of the container assembly to prevent or inhibit opening of the container assembly, wherein the outer cover is configured to initially move with respect to the container by pushing the front of the container and moving the outer cover with respect to the container such that the minor front flap of the outer cover clears the at least one minor exterior flap of the container allowing the container assembly to be moved from the closed position to an open position, wherein the two minor front flaps of the container are folded over each other and adhesively attached to each other.

2. The container assembly of claim 1, wherein the aperture is in a general rectangular shape.

3. The container assembly of claim 1, wherein the container assembly includes product therein.

4. The container assembly of claim 1, wherein a length of the container assembly is from about 10 to about 30 inches.

5. The container assembly of claim 4, wherein a width of the container assembly is from about 5 to about 15 inches.

6. The container assembly of claim 1, wherein the back of the outer cover includes a minor interior flap.

7. The container assembly of claim 1, wherein the container further includes a top.

8. The container assembly of claim 1, wherein at least a portion of the at least one minor exterior flap tapers inwardly towards a center of the container.

9. The container assembly of claim 1, wherein the container assembly comprises paperboard.

10. The container assembly of claim 1, wherein at least a portion of the at least one minor exterior flap tapers inwardly towards a center of the container at an angle of from about 10 to about 60 degrees.

11. A container assembly comprising:

an outer cover being formed from an outer cover blank including a first plurality of panels and a first plurality of flaps integrally formed from a first sheet of material, the first plurality of panels including a first side panel, a second side panel, a back panel, a front panel and a top panel, the first plurality of flaps including a minor front flap being attached to the front panel via a fold line;

a container being formed from a container blank including a second plurality of panels and a second plurality of flaps integrally formed from a second sheet of material, the second plurality of panels including a first side panel, a second side panel, a back panel, a front panel and a bottom panel of the container, the back panel assisting in forming an aperture, the second plurality of flaps including at least one minor exterior flap configured to be folded and adhesively attached to the front panel, the at least one minor exterior flap of the container including two minor front flaps, and wherein the container is configured to be received in the outer cover in a closed position, wherein the outer cover is configured to initially move with respect to the container by pushing the front panel of the container and moving the outer cover with respect to the container such that the minor front flap of the outer cover clears the at least one minor exterior flap attached to the front panel of the container allowing the container assembly to be moved from the closed position to an open position, wherein the two minor front flaps of the container are folded over each other and adhesively attached to each other.

12. The container assembly of claim 11, wherein the front panel of the outer cover blank is attached to the top panel of the outer cover blank via a fold line, where the back panel of the outer cover blank is attached to the top panel of the outer cover blank via a fold line, the first and second side panels of the outer cover blank being attached to the back panel of the outer cover blank on opposing sides via respective fold lines.

13. The container assembly of claim 12, wherein the outer cover blank further includes a first major front flap and a second major front flap, the first major front flap being attached to the first side panel via a fold line, the second major front flap being attached to the second side panel via a fold line.

14. The container assembly of claim 11, wherein the outer cover blank further includes a minor back flap being attached to the back panel of the outer cover blank via a fold line.

15. The container assembly of claim 11, wherein the back panel of the container blank and the front panel of the container blank are attached to opposing sides of the bottom panel via respective fold lines, the first and second side panels of the container blank being attached to opposing sides of the back panel of the container blank.

16. The container assembly of claim 11, wherein the container blank further includes first and second top panels, the first and second top panels being attached to the back panel of the container blank and to one of the at least one minor exterior flap of the container blank via respective fold lines.

17. The container assembly of claim 11, wherein the aperture is in a general rectangular shape.

18. The container assembly of claim 11, wherein a length of the container assembly is from about 10 to about 30 inches, and a width of the container assembly is from about 5 to about 15 inches.

19. The container assembly of claim 11, wherein the container assembly comprises paperboard.

20. The container assembly of claim 11, wherein each of the two minor front flaps forming the at least one minor exterior flap of the container tapers inwardly towards a center of the container at an angle of from about 10 to about 60 degrees.

21. A method of opening a container assembly, the method comprising:

providing a container assembly in a closed position, the container assembly including an outer cover and a container, the outer cover including a front, a back, first and second sides, a top and an open end opposite of the top, the front of the outer cover including a minor front flap located on an interior surface of the outer cover, the container including a front, a back, first and second sides, and a bottom, the front of the container including at least one minor exterior flap, the at least one minor exterior flap of the container including two minor front flaps, the container being configured to be received in the open end of the outer cover when in a closed position, the container forming an aperture, wherein the minor front flap of the outer cover and the at least one minor exterior flap of the container are generally aligned in a plane in a closed position of the container assembly to prevent or inhibit opening of the container assembly, the two minor front flaps of the container being folded over each other and adhesively attached to each other; and pushing on the front of the container below an edge of the outer cover such that the minor front flap of the outer cover clears the at least one minor exterior flap of the container and simultaneously moving the outer cover away from the container such the container assembly moves from the closed position to an open position.

22. The method of claim 21, wherein each of the two minor front flaps forming the at least one minor exterior flap of the container tapers inwardly towards a center of the container at an angle of from about 10 to about 60 degrees.

* * * * *